US008596855B2

(12) United States Patent
Schauerte et al.

(10) Patent No.: US 8,596,855 B2
(45) Date of Patent: Dec. 3, 2013

(54) METERING APPARATUS AND METHOD FOR INTRODUCING A POWDERY MEDIUM INTO A FLUID

(75) Inventors: Manfred Schauerte, Schmallenberg (DE); Markus Hamers, Lennestadt (DE); Meinolf Rameil, Lennestadt (DE)

(73) Assignee: Tracto-Technik GmbH & Co. KG, Lennestadt (DE)

( * ) Notice: Subject to any disclaimer, the term of this patent is extended or adjusted under 35 U.S.C. 154(b) by 316 days.

(21) Appl. No.: 12/908,201

(22) Filed: Oct. 20, 2010

(65) Prior Publication Data

US 2011/0255363 A1 Oct. 20, 2011

(30) Foreign Application Priority Data

Oct. 21, 2009 (DE) ..... 10 2009 050 059

(51) Int. Cl.
*B28C 7/16* (2006.01)
*B01F 15/00* (2006.01)
*B01F 7/00* (2006.01)

(52) U.S. Cl.
USPC ..... 366/50; 366/168.1; 366/172.1; 366/318

(58) Field of Classification Search
USPC ..... 366/133, 163.2, 191, 108, 137.1, 366/165.1–165.5, 163.1, 164.6, 1–68
See application file for complete search history.

(56) References Cited

U.S. PATENT DOCUMENTS

| | | | | | |
|---|---|---|---|---|---|
| 1,731,953 | A | * | 10/1929 | Thomson | 366/5 |
| 3,231,245 | A | * | 1/1966 | Harvey | 366/28 |
| 3,251,653 | A | * | 5/1966 | Aditya | 366/165.1 |
| 3,819,157 | A | | 6/1974 | Markfelt | |
| 3,881,656 | A | | 5/1975 | Markfelt et al. | |
| 4,184,771 | A | * | 1/1980 | Day | 366/3 |
| 4,586,854 | A | * | 5/1986 | Newman et al. | 406/153 |
| 4,780,220 | A | * | 10/1988 | Peterson | 507/107 |
| 6,074,085 | A | * | 6/2000 | Scarpa et al. | 366/101 |
| 7,575,071 | B2 | | 8/2009 | Schauerte | |
| 8,206,024 | B2 | * | 6/2012 | Wenzel et al. | 366/118 |
| 2002/0125046 | A1 | | 9/2002 | Schauerte | |
| 2004/0007272 | A1 | * | 1/2004 | Gershtein et al. | 137/574 |
| 2008/0041449 | A1 | | 2/2008 | Schauerte | |

FOREIGN PATENT DOCUMENTS

| | | |
|---|---|---|
| DE | 199 18 775 B4 | 4/2000 |
| DE | 102009023546 | 12/2010 |
| WO | WO 03/043723 | 5/2003 |

* cited by examiner

*Primary Examiner* — Tony G Soohoo
*Assistant Examiner* — Anshu Bhatia
(74) *Attorney, Agent, or Firm* — Henry M. Feiereisen LLC

(57) ABSTRACT

A metering apparatus for introducing a powdery medium into a fluid includes a mixing vessel that can be filled with a fluid and a metering unit for the powdery medium. The metering unit has an inlet for the powdery medium, an inlet for a compressed gas and an outlet extending towards the mixing vessel, through which the powdery medium and the compressed gas can be discharged into the mixing vessel.

9 Claims, 3 Drawing Sheets

METERING APPARATUS AND METHOD FOR INTRODUCING A POWDERY MEDIUM INTO A FLUID

CROSS-REFERENCES TO RELATED APPLICATIONS

This application claims the priority of German Patent Application, Serial No. 10 2009 050 059.6, filed 21 Oct. 2009, pursuant to 35 U.S.C. 119(a)-(d), the content of which is incorporated herein by reference in its entirety as if fully set forth herein.

BACKGROUND OF THE INVENTION

The present invention relates to a metering apparatus for introducing a powdery medium into a fluid. The invention also relates to a mixing plant having such a metering apparatus for mixing a drilling fluid, as well as to a method for introducing a powdery medium into a fluid.

The following discussion of related art is provided to assist the reader in understanding the advantages of the invention, and is not to be construed as an admission that this related art is prior art to this invention.

A drilling fluid is typically employed for supporting the drill feed when constructing drill holes in the ground, in particular horizontal drill holes. The drilling fluid is used to soften the ground in advance of the drill head of the drilling apparatus to improve the cutting performance of the drill head. The drilling fluid can also be used to lubricate the drill head and the drill rod, which is rotatably driven in the drill hole, so as to reduce friction with the ground. In addition, the drilling fluid can be used to flush out the soil removed by the drill head through the annular gap between the drill rod and the wall of the drill hole or through an annular gap of dual drill rods.

The drilling fluid is typically a mixture of water and bentonite, and sometimes several additives. Bentonite is a mixture of different clay materials, with the largest component being montmorillonite (generally with a content of 60% to 80%). Additional accompanying materials may be quartz, mica, feldspar, pyrite and sometimes also calcite. Due to the montmorillonite content, bentonite has strong water absorption and swelling capability.

Water into which bentonite has been stirred can have thixotropic characteristics, so that it behaves like a fluid when in motion, but like a solid structure when at rest. Because of this behavior, a drilling fluid composed of water and bentonite can also be used for supporting the wall of the drill hole, thereby preventing a collapse.

The introduction of bentonite into water poses a particular challenge, because the bentonite has the tendency to lump together in contact with water. The drilling fluid is typically stirred in large storage vessels with dynamic mixing devices and thereafter transported in batches to the construction site where the drilling fluid is to be used. However, such batchwise mixing is quite cumbersome. In addition, after the drill hole has been completed, the unused portion of the last batch must be disposed of, which is complex and expensive.

Bentonite can also be introduced directly in the water in the region of a high-pressure pump, which is provided for transporting the drilling fluid through the drill rod to the drill head of a horizontal drilling apparatus, in order to take advantage of the turbulences produced in the water by the high-pressure pump for mixing the bentonite with the water. A swelling section can be arranged downstream of the high-pressure pump, where the bentonite-water-mixture is given time to swell before it is transported through the drill rod to the drill head.

It would therefore be desirable and advantageous to obviate prior art shortcomings and to provide metering device for introducing a powdery medium into a fluid, whereby problems associated with lumping of the powdery medium upon contact with the fluid can be reduced or even eliminated. It would also be desirable to provide a corresponding method and a mixing plant for mixing a drilling fluid.

SUMMARY OF THE INVENTION

According to one aspect of the present invention, a metering apparatus for introducing a powdery medium into a fluid includes a mixing vessel constructed to be filled with the fluid, and a metering unit for the powdery medium, wherein the metering unit comprises a first inlet for the powdery medium, a second inlet for a compressed gas, and an outlet extending into the mixing vessel for discharging the powdery medium and the compressed gas into the mixing vessel.

The apparatus is constructed to prevent to the greatest extent possible lumping of the powdery medium by introducing the medium before contact with the fluid in a compressed gas flow, and to then blow the powdery medium together with this compressed gas flow into the fluid.

By blowing the powdery medium into the fluid with a compressed gas flow, turbulence can be advantageously produced within the fluid, which promotes effective mixing of the components.

In one exemplary embodiment of the metering apparatus according to the invention, the powdery medium and the compressed gas may be introduced into the metering unit via different inlets, i.e., the powdery medium via a first inlet and the compressed gas via a second inlet. With this configuration, the powdery medium can be metered more finely than would be possible with a common inlet.

Advantageously, metering of the powdery medium intended for mixing with the compressed gas flow can also be improved by integrating into metering unit a dynamic metering element, for example a metering screw. The quantity of the powdery medium mixed with the compressed gas flow may be intentionally affected by controlling the rotation speed of the metering screw.

To particularly effectively mix the powdery medium with the fluid, the outlet of the metering unit may protrude into a region of the mixing vessel which is filled with the fluid when the metering unit is in operation.

In one exemplary embodiment, mixing the powdery medium with the fluid can also be improved by orienting the flow directions of, on one hand, the fluid and, on the other hand, the powdery medium in opposite directions at the time of mixing. The resulting forced reversal of the particles of the powdery medium can improve intermixing. This can be attained with an apparatus by arranging an inlet for the fluid and an outlet for the fluids (the fluids which are intermixed with the powdery medium) so that the fluid flows in a first direction, whereas the outlet of the metering unit is oriented so that the compressed gas as well as of the entrained powdery medium flows in a second direction opposite the first direction. According to the invention, it may be sufficient that only components of the two flow directions are oriented in opposite directions.

Opposing flow directions of the fluid, on one hand, and of the mixture consisting of the compressed gas and the powdery medium, on the other hand, may be generated, for example, by arranging the inflow for the fluid in a lower region of the mixing vessel and the outflow for the fluid (the fluid which is intermixed with the powdery medium) in an upper region of the mixing vessel, so that the fluid has a tendency to flow upward. At the same time, the outlet of the metering unit can be oriented such that the compressed gas with the powdery medium flows into the mixing vessel in a direction which tends to be oriented downward.

Advantageously, excellent mixing of the powdery medium with the fluid can also be achieved by having the outlet of the metering unit protrude centrally into the mixing vessel.

In another exemplary embodiment, intermixing of the total fluid with the powdery medium may be improved further by additionally impressing turbulence on the fluid in the mixing vessel, for example, by forcing a helical flow pattern onto the fluid between the inflow and the outflow. The individual water molecules then travel a relatively long path inside the mixing vessel, potentially increasing the residence time inside the mixing vessel and improving intermixing with the powdery medium.

In one exemplary embodiment, a helical flow of the fluid can be generated by employing a mixing vessel with a round (i.e., circular, oval, etc.) interior cross-section and a tangential inflow for the fluid. Additionally or alternatively, suitable guiding means may be arranged inside the mixing vessel to promote the generation of such helical flow of the fluid.

In another preferred embodiment of the present invention, mixing of the powdery medium with the fluid can be improved with (additional) static or dynamic mixing elements. For example, one or more injector nozzles projecting into the mixing vessel may be provided, through which a compressed gas is introduced into the mixing vessel. The compressed gas exiting from the injector nozzles into the mixing vessel can further intermix the fluid and the particles of the powdery medium dispersed therein through turbulence, thereby further improving their mixing.

Alternatively or in addition, a similar effect may be produced by introducing ultra-sound waves into the mixing vessel with an ultrasound generator, thereby further improving intermixing of the fluid with the powdery medium.

The metering apparatus according to the invention is particularly suited for introducing bentonite into an aqueous fluid and particularly into (clean) water.

According to another aspect of the invention, a mixing plant for mixing a drilling fluid includes a metering apparatus according to the invention, a bentonite supply connected with the metering unit of the metering apparatus, a supply of compressed gas connected with the metering unit, a water supply connected with the mixing vessel, and a pump.

Preferably, the pump of the mixing plant according to the invention may be a high-pressure pump which enables construction of a continuous mixing plant, because a high-pressure pump is capable of producing a pressure sufficient for transporting the drilling fluid through a (hollow) drill rod of a drill string (drill rod and drill head).

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 1 shows in an isometric view an exemplary embodiment of a metering apparatus according to the invention in;

DETAILED DESCRIPTION OF PREFERRED EMBODIMENTS

Figure 1:
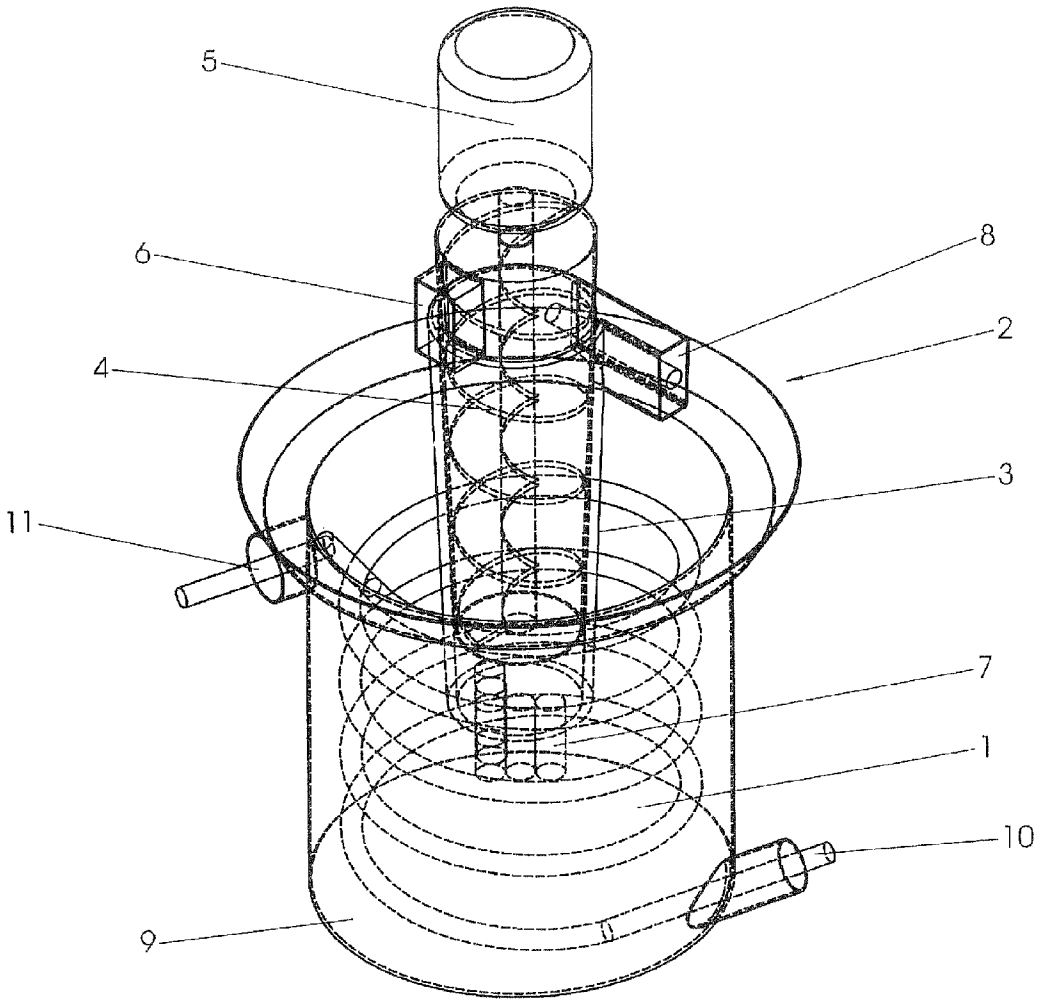

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a metering apparatus according to the invention which includes a mixing vessel 1 with a round cross-section, and a metering unit 2 arranged above the mixing vessel 1 and partially protruding into the interior space of the mixing vessel 1. The metering unit 2 includes a hollow-cylindrical housing 3, with a metering screw 4 rotatably supported in the interior space of the hollow-cylindrical housing 3. The metering screw 4 is rotated by way of an electric motor 5 (or any other type of rotary drive). The rotation speed of the electric motor 5 is controllable by a controller (not illustrated) to which the electric motor 5 can be connected. An inlet 6 for a powdery medium, in the present example bentonite, is disposed in an upper region of the housing 3 of the metering unit 2. The bentonite is introduced into the interior space of the housing 3 through this inlet 6 and transported from this location by the metering screw 4 towards the outlet 7 which is disposed on the lower end of the housing 3 of the metering unit 2. The quantity of bentonite discharged into the mixing vessel 1 through the outlet 7 can be controlled based on the rotation speed of the metering screw 4. An additional inlet 8 for the bentonite is disposed in the housing 3 of the metering unit 2 just below the inlet 6, through which a compressed gas, in the following example compressed air, can be blown into the interior space of the housing 3 of the metering unit 2. The compressed air flows through the housing 3 of the metering unit 2, entraining the bentonite particles and discharging the particles into the mixing vessel 1 through the outlet 7 of the metering unit 2 with a relatively high velocity, where the bentonite particles are then mixed with a fluid, in the present example water.

Water is supplied to the mixing vessel 1 via an inflow 10 arranged in the region of the bottom 9 of the mixing vessel 1 and, after mixing with the bentonite powder, discharged again via an outflow 11 arranged in the upper region of the mixing vessel 1. Both the inflow 10 and the outflow 11 are oriented such that the flow direction of the fluid is about tangential with respect to the interior wall of the mixing vessel 1 when the fluid enters the mixing vessel 1 and exits from the mixing vessel 1. In this way, a fluid flow is generated which extends in helical form along the interior wall of the mixing vessel 1 from the inflow 10 to the outflow 11. This fluid flow encounters in a central region of the mixing vessel 1 a likewise helical flow of the compressed air mixed with the bentonite powder which, however, tends to move towards the bottom 9 of the mixing vessel and hence opposes the flow direction of the fluid. The helical flow of the compressed air mixed with the bentonite powder is also generated because the inlet for the compressed air is oriented tangentially with respect to the inner wall of the housing 3 of the metering unit 2. The result is a clockwise helical flow of the fluid, which moves from the bottom towards the top, and a counterclockwise helical flow of the compressed air mixed with the bentonite powder, which moves towards the bottom, in a central region of the mixing vessel 1. In this way, the fluid swirls extensively with the compressed air and the bentonite powder in the region of the outlet of the metering unit, promoting excellent mixing of the bentonite powder with the fluid.

Figure 2:
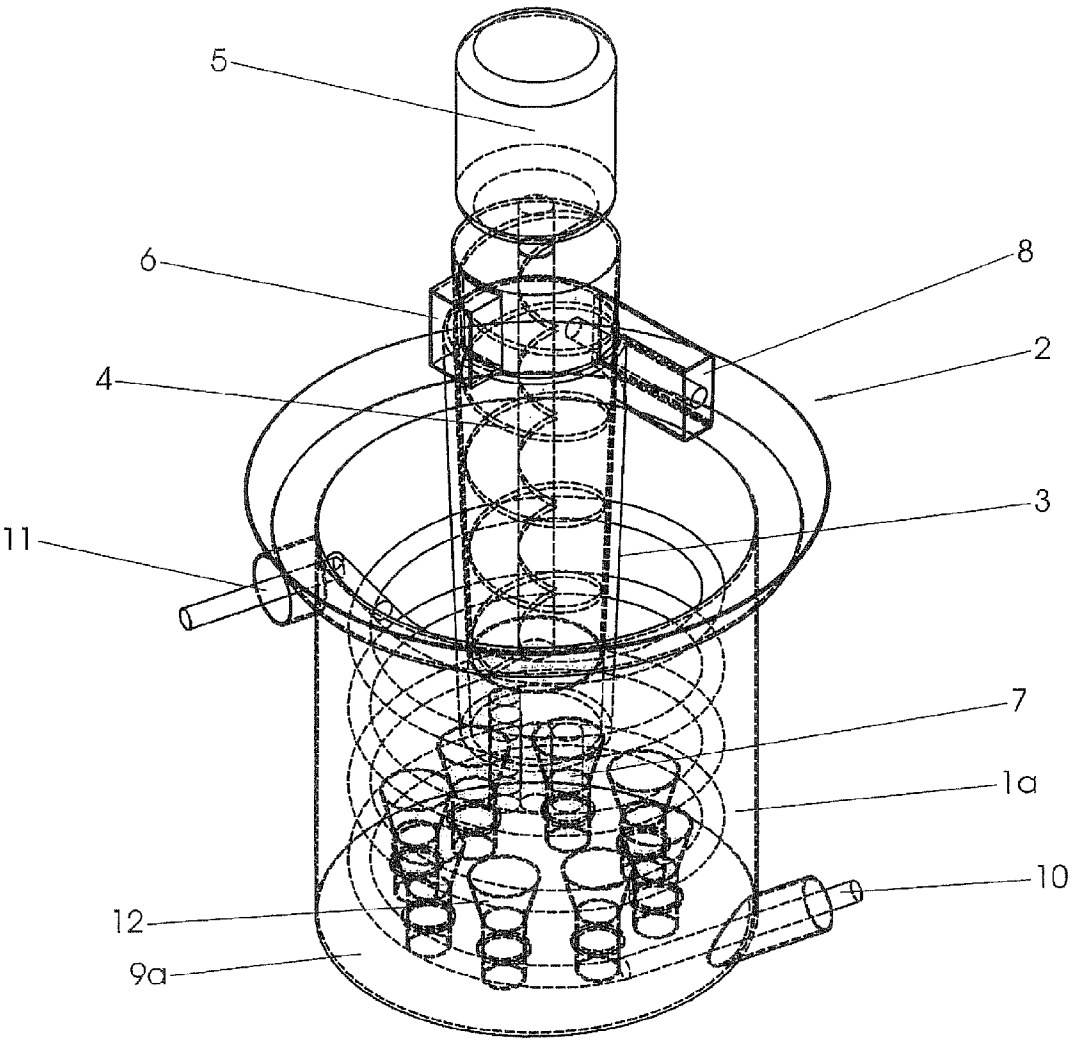
FIG. 2 shows in an isometric view another exemplary embodiment of a metering apparatus according to the invention.

The embodiment of a metering apparatus according to the invention shown in FIG. 2 differs from that of FIG. 1 only in the additional arrangement of several compressed injection air nozzles 12 in the bottom 9*a* of the mixing vessel 1*a*. The compressed air exiting the injection nozzles promotes mixing of the bentonite powder with the fluid inside the mixing vessel.

Figure 3:
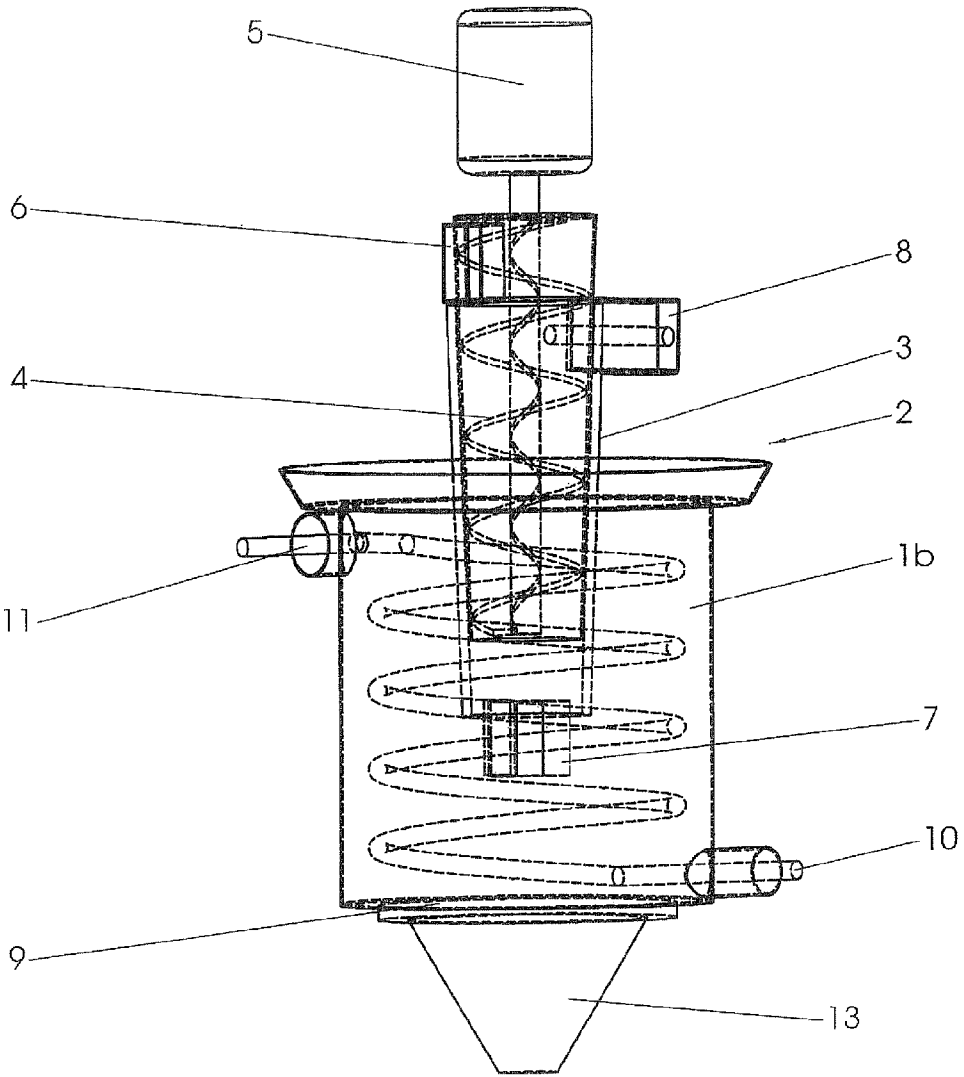
FIG. 3 shows in an isometric view yet another exemplary embodiment of a metering apparatus according to the invention.

The embodiment of a metering apparatus according to the invention illustrated in FIG. 3 differs from that of FIG. 1 in the additional arrangement of an ultrasound generator 13 which generates ultrasound waves and radiates these waves towards the interior space of the mixing vessel 1*b*. Like the compressed air exiting the compressed air injection nozzles 12 in the metering apparatus illustrated in FIG. 2, the sound waves promote mixing of the bentonite powder with the fluid.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed is:

1. A metering apparatus for introducing a powdery medium into a fluid, comprising a mixing vessel constructed to be filled with the fluid and comprising an inflow and an outflow for the fluid arranged on a same interior wall of the mixing vessel so as to generate a flow of the fluid in a first direction, and a metering unit for the powdery medium, wherein the metering unit comprises a metering screw, a first inlet for the powdery medium, a second inlet for a compressed gas, and an outlet extending into the mixing vessel for discharging the powdery medium and the compressed gas into the mixing vessel at least in a region of the outlet with a flow in a second direction opposite the first direction, wherein the powdery medium and the fluid are mixed at the outlet of the metering unit.

2. The metering apparatus of claim 1, wherein the outlet extends into the mixing vessel up to a region which is filled with the fluid during operation.

3. The metering apparatus of claim 1, wherein the outlet extends into a center of the mixing vessel.

4. The metering apparatus of claim 1, wherein the mixing vessel has a round interior cross-section and wherein the inflow for the fluid which is oriented tangentially with respect to an interior wall of the mixing vessel.

5. The metering apparatus of claim 1, further comprising at least one injection nozzle projecting into the mixing vessel for the compressed gas.

6. The metering apparatus of claim 1, further comprising an ultrasound generator radiating ultrasound waves towards the mixing vessel.

7. A mixing plant for mixing a fluid with a powdery medium to produce a drilling fluid, the mixing plant having a pump and a metering apparatus, with the metering apparatus comprising:

a mixing vessel constructed to be filled with the fluid from a fluid supply and comprising an inflow and an outflow for the fluid arranged on a same interior wall of the mixing vessel so as to generate a flow of the fluid in a first direction, and a metering unit for the powdery medium, wherein the metering unit comprises a first inlet for the powdery medium, a second inlet for a compressed gas, and an outlet extending into the mixing vessel for discharging the powdery medium and the compressed gas into the mixing vessel at least in a region of the outlet with a flow in a second direction opposite the first direction, wherein the powdery medium and the fluid are mixed at the outlet of the metering unit.

8. The mixing plant of claim 7, wherein the pump is a high-pressure pump.

9. A method for introducing a powdery medium into a fluid, comprising the steps of:

generating in the mixing vessel a continuous flow of the fluid between an inflow and an outflow in a first direction, generating in the mixing vessel a flow of compressed gas together with the powdery medium in a second direction opposing the first direction through an outlet of a metering unit, merging of a helical fluid flow and a helical flow of the compressed gas together with the powdery medium for mixing the powdery medium with the fluid, wherein the powdery medium and the fluid are mixed at the outlet of the metering unit.

* * * * *